US008410890B2

(12) United States Patent
Fisher

(10) Patent No.: US 8,410,890 B2
(45) Date of Patent: Apr. 2, 2013

(54) COMBINATION WIRE CONNECTOR AND CURRENT TRANSFORMER

(75) Inventor: Mark J. Fisher, Murfreesboro, TN (US)

(73) Assignee: Schneider Electric USA, Inc., Palatine, IL (US)

( * ) Notice: Subject to any disclaimer, the term of this patent is extended or adjusted under 35 U.S.C. 154(b) by 683 days.

(21) Appl. No.: 12/626,219

(22) Filed: Nov. 25, 2009

(65) Prior Publication Data

US 2011/0121932 A1 May 26, 2011

(51) Int. Cl.

| | |
|---|---|
| ***H01F 27/28*** | (2006.01) |
| ***H01F 27/02*** | (2006.01) |
| ***H01F 27/29*** | (2006.01) |
| ***H01R 4/50*** | (2006.01) |

(52) U.S. Cl. ..... 336/229; 336/90; 336/182; 336/192; 336/195; 439/805

(58) Field of Classification Search ..... 336/229, 336/90, 182, 192, 195; 439/805
See application file for complete search history.

(56) References Cited

U.S. PATENT DOCUMENTS

| | | | | |
|---|---|---|---|---|
| 2,892,167 | A * | 6/1959 | Ritz | 336/174 |
| 4,507,709 | A * | 3/1985 | Morris et al. | 361/782 |
| 4,907,342 | A | 3/1990 | Castonguay et al. | 29/622 |
| 5,327,112 | A | 7/1994 | Rossetti | 335/78 |
| 5,889,450 | A | 3/1999 | Kim et al. | 355/18 |
| 6,639,770 | B2 | 10/2003 | Tiemann et al. | 361/45 |
| 6,930,610 | B2 | 8/2005 | Gao et al. | 340/635 |
| 7,002,440 | B2 | 2/2006 | Attarian et al. | 335/18 |
| 7,026,894 | B2 | 4/2006 | Tobin et al. | 335/16 |
| 7,427,856 | B2 | 9/2008 | Jones | 324/117 |
| 7,477,501 | B2 | 1/2009 | Nelson et al. | 361/93 |
| 7,493,222 | B2 | 2/2009 | Bruno | 702/64 |
| 7,511,229 | B2 | 3/2009 | Vlasak et al. | 174/267 |
| 7,514,932 | B2 | 4/2009 | Murry et al. | 324/508 |
| 7,535,686 | B2 | 5/2009 | Valdes et al. | 361/42 |
| 2006/0274482 | A1 | 12/2006 | Vlasak et al. | 174/267 |
| 2008/0012677 | A1 | 1/2008 | Colsch et al. | 336/178 |
| 2008/0188140 | A1 * | 8/2008 | Hill et al. | 439/805 |
| 2009/0015184 | A1 | 1/2009 | Knierim | 318/490 |
| 2009/0045892 | A1 | 2/2009 | Nelson et al. | 335/202 |

FOREIGN PATENT DOCUMENTS

| | | |
|---|---|---|
| DE | 18 74 873 | 7/1963 |
| DE | 37 38 907 A1 | 6/1989 |
| EP | 2 015 320 A1 | 1/2009 |

OTHER PUBLICATIONS

PCT International Search Report for International Application No. PCT/US2010/056649 dated May 24, 2011 (3 pages).

PCT International Written Opinion for International Application No. PCT/US2010/056649 dated May 24, 2011, (7 pages).

Square-D; "*Instruction Bulletin: One-Pole QO® and QOB Equipment Protective Device (EPD ) (30 mA Ground-Fault Trip Level)*"; Sep. 2003 (4 pages).

(Continued)

*Primary Examiner* — Mohamad Musleh
*Assistant Examiner* — Ronald Hinson
(74) *Attorney, Agent, or Firm* — Nixon Peabody LLP

(57) ABSTRACT

A transformer assembly for mounting a current transformer to an electrical apparatus. The generally toroidal current transformer senses electrical current in conductors of the electrical apparatus and has a housing. A mechanical lug for conductors of the electrical apparatus is mounted directly to the housing of the current transformer, within the central opening of the toroid. The mechanical lug has one or more conductor bores located within a main body of the mechanical lug for receiving respective conductor wires.

15 Claims, 6 Drawing Sheets

OTHER PUBLICATIONS

Square-D; "*Instruction Bulletin: HOM One-Pole Equipment Protection Device (EPD)*"; Nov. 2003 (4 pages).
Square-D; "*Instruction Bulletin: HOM Two-Pole Equipment Protection Device (EPD)*"; Nov. 2003 (6 pages).
Square-D; "*Instruction Bulletin: Two-Pole QO®/QOB Circuit Breaker and Equipment Protective Device (EPD) (30 mA Ground-Fault Trip Level)*"; Apr. 2008 (4 pages).
Square-D; "*Neutral Current Transformers for Masterpact® NT, P-Frame and NS630b-NS1600 Circuit Breaker*"; Apr. 2008 (6 pages).
Square-D; "*Instruction Bulletin: GFM150HD and GFM250JD Ground-Fault Modules With Micrologic® Trip Level*"; Jul. 2008 (20 pages).

* cited by examiner

COMBINATION WIRE CONNECTOR AND CURRENT TRANSFORMER

FIELD OF THE INVENTION

This invention is directed generally to a current transformer for an electrical apparatus, and, more particularly, to a current transformer mounted to a mechanical lug.

BACKGROUND OF THE INVENTION

An electrical current transformer is generally included in an electrical apparatus, such as a circuit breaker or a busbar assembly, for sensing electrical current. Typically, the current transformer includes a toroidal coil of thin conducting wire wrapped around a core for sensing electrical current passing through the current transformer. The current transformer is physically mounted to a support bracket, on or within the electrical apparatus, for providing structural support, and is electrically coupled to conductor wires of the electrical apparatus which pass through the center of the toroid for monitoring the current in the wires. The conductive wires connecting the electrical apparatus to the rest of the electrical circuit are typically bound to the electrical apparatus by means of mechanical lugs affixed to the body of the electrical apparatus.

SUMMARY OF THE INVENTION

In an implementation of the present invention, a transformer assembly includes a current transformer and a lug (or wire connector) that are mounted together, with the current transformer surrounding the lug. The lug provides the necessary strength and features to support the current transformer and eliminates the need for a secondary support bracket for the current transformer. This implementation also places the conductive wires bound by the lug and the current transformer in close proximity so to eliminate the need for extra conductive wire to be routed through a separately mounted current transformer. In general, the transformer assembly combines elements of current sensing technologies (for monitoring and measuring electrical currents) with elements of wire terminations (for connecting wires and cables to electrical bus bars). The transformer assembly provides several advantages, including (i) reducing the amount of electrical conductor material; (ii) eliminating the need for a separate element to support the current transformer; and (iii) reducing space requirements within the equipment in which the transformer assembly is mounted. The transformer assembly can be applied to any electrical apparatus that uses current sensing and wire terminations.

The current transformer senses electrical current in an electrical apparatus and has a housing with an internal opening. A mechanical lug, which is attached to the electrical apparatus, is mounted directly to the housing of the current transformer, within the internal opening. The mechanical lug has a plurality of conductor bores located within a main body of the mechanical lug for receiving respective conductor wires.

In an alternative implementation of the present invention, a transformer assembly includes a mechanical lug that is physically and electrically mounted directly to an electrical apparatus via a fastener component. The mechanical lug includes a plurality of conductor bores for receiving, respectively, a plurality of conductor wires, the conductor wires being attached to the mechanical lug via respective conductor fasteners. The transformer assembly further includes a current transformer, for sensing electrical current in the electrical apparatus, which is physically connected directly to the mechanical lug by having an internal opening in which the mechanical lug is received.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
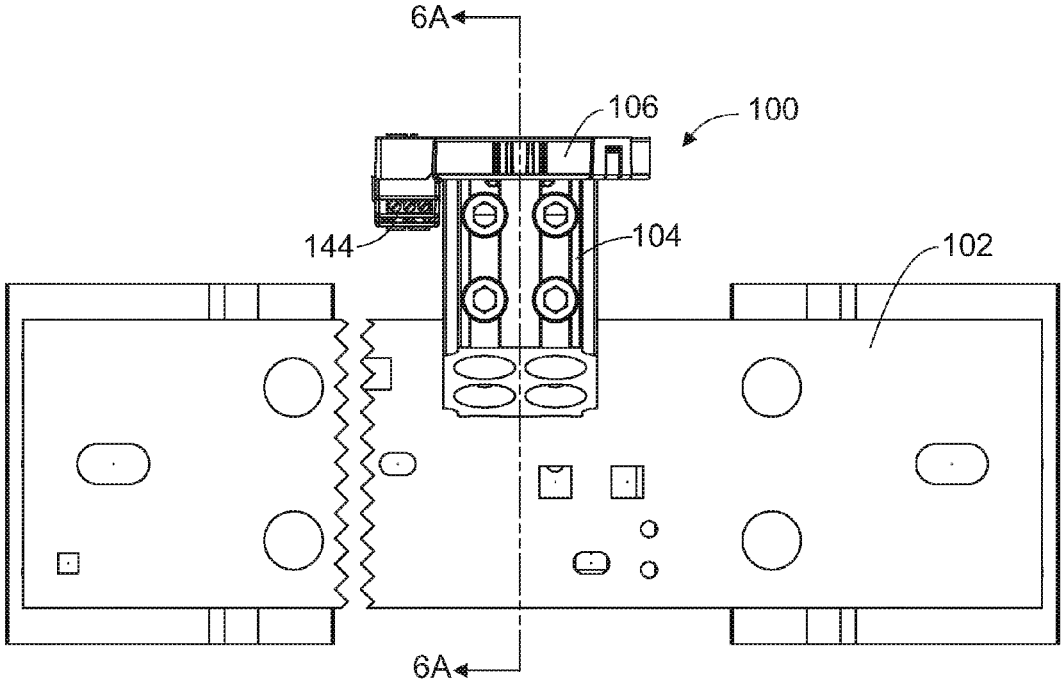
FIG. 1 is a top view of a transformer assembly mounted to a busbar system.

Referring to FIG. 1, a transformer assembly 100 is mounted to a busbar system 102. In alternative embodiments, the transformer assembly 100 is mounted to any other electrical apparatus that uses current sensing and conductor wire terminations, e.g., busbars, circuit breakers, switches, etc.

The transformer assembly 100 includes a mechanical lug 104 and a current transformer 106. The mechanical lug 104 is a conductor that can be made from any electrically conductive material, such as aluminum or copper. As described in more detail below, the mechanical lug 104 provides the supporting structure for the current transformer 106 and secures conductor wires.

Figure 2A:
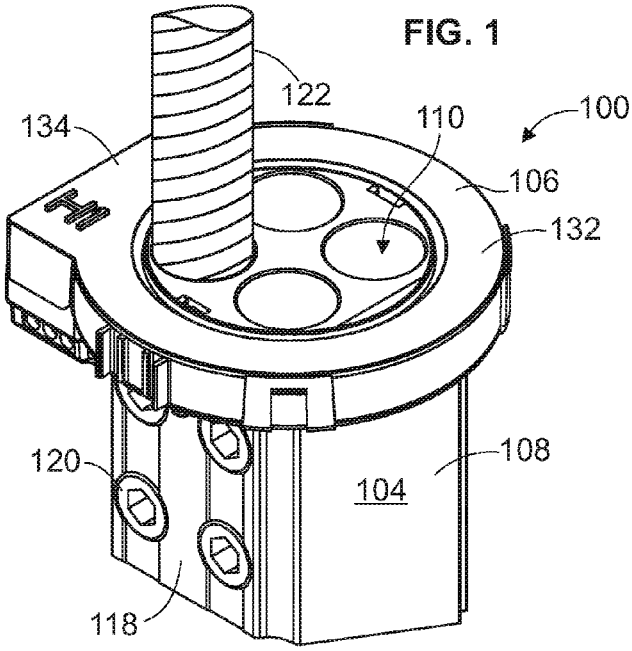
FIG. 2A is a perspective assembled view of a four-wire transformer assembly.
Figure 2B:
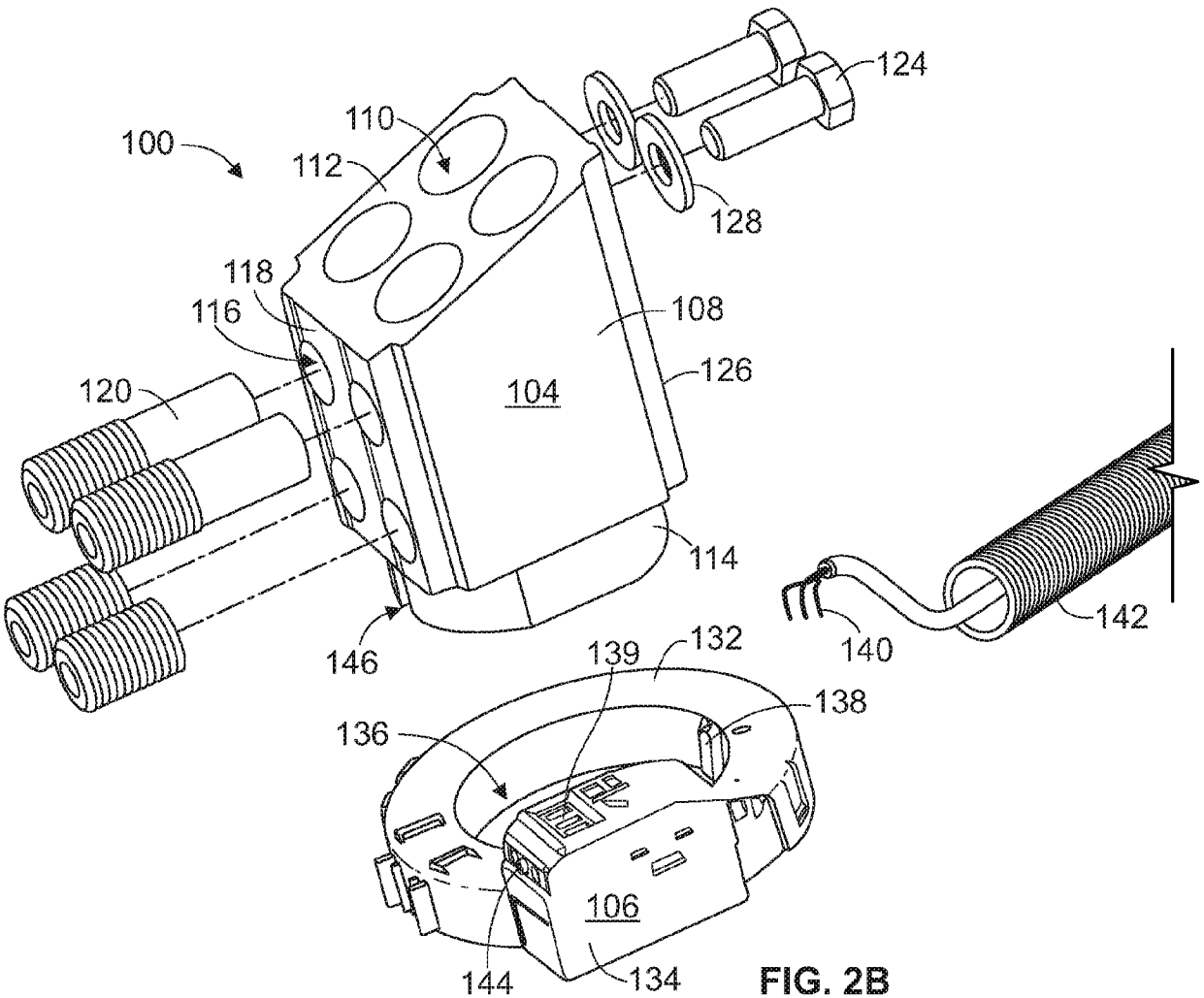
FIG. 2B is a perspective exploded view of the four-wire transformer assembly shown in FIG. 2A.

Referring to FIGS. 2A and 2B, the mechanical lug 104 has a main body 108 in which a plurality of conductor bores 110 are located. The conductor bores 110 extend from an open end 112 throughout the main body 108 to a mounting end 114, and are optionally parallel to each other. Although shown having a circular shape, the conductor bores 110 can have any other shape.

In a perpendicular direction to the direction of the conductor bores 110, the mechanical lug 104 includes a plurality of fastener openings, collectively identified as 116. The fastener openings 116 extend from a left side 118 through the main body 108 to a respective one of the conductor bores 110.

The mechanical lug 104 can have any number of conductor bores 110. For example, referring to FIG. 3, the mechanical lug 104 can have four conductor bores 110 (instead of three).

A plurality of conductor fasteners 120 are connected to the mechanical lug 104 in the fastener openings 116. The conductor fasteners 120 can be, for example, wire binding screws or other wire retention devices. The conductor fasteners 120 secure conductor wires 122 in the respective conductor bores 110. The conductor wires 122 are generally the same phase or neutral.

The mechanical lug 104 further includes a plurality of fastening components 124 that are mounted to a right side 126 of the main body 108. The fastening components 124 can be bolts, screws, rivets, etc. The fastening components 124 physically and electrically connect the mechanical lug 104 directly to the busbar system 102. A plurality of washers 128 are connected between the fastener components 124 and a mounting surface 130 (shown in FIG. 4A) of the busbar system 102.

The wound toroidal current transformer 106 is surrounded by a housing 132. The housing 132 has an internal opening 136 into which at least one connecting tab 138 extends in a radial direction for securing the current transformer 106 to the mechanical lug 104, as explained in more detail below. The housing 132 further has an electrical coupling region 134 which has a plurality of wire receivers 139 for receiving a plurality of signal wires 140 for the transformer's sensing function. The signal wires 140 are optionally routed in a wiring harness 142 and are secured in the respective wire receivers 139 via a plurality of screws 144 or other retention devices.

The mounting end 114 of the mechanical lug 104 is inserted within the internal opening 136 of the current transformer 106. The mechanical lug 104 provides structural support for the current transformer 106 and mounts the current transformer 106 to the busbar system 102 (or to other devices such as circuit breakers or switches), eliminating a need for extraneous mounting brackets.

Figure 3:
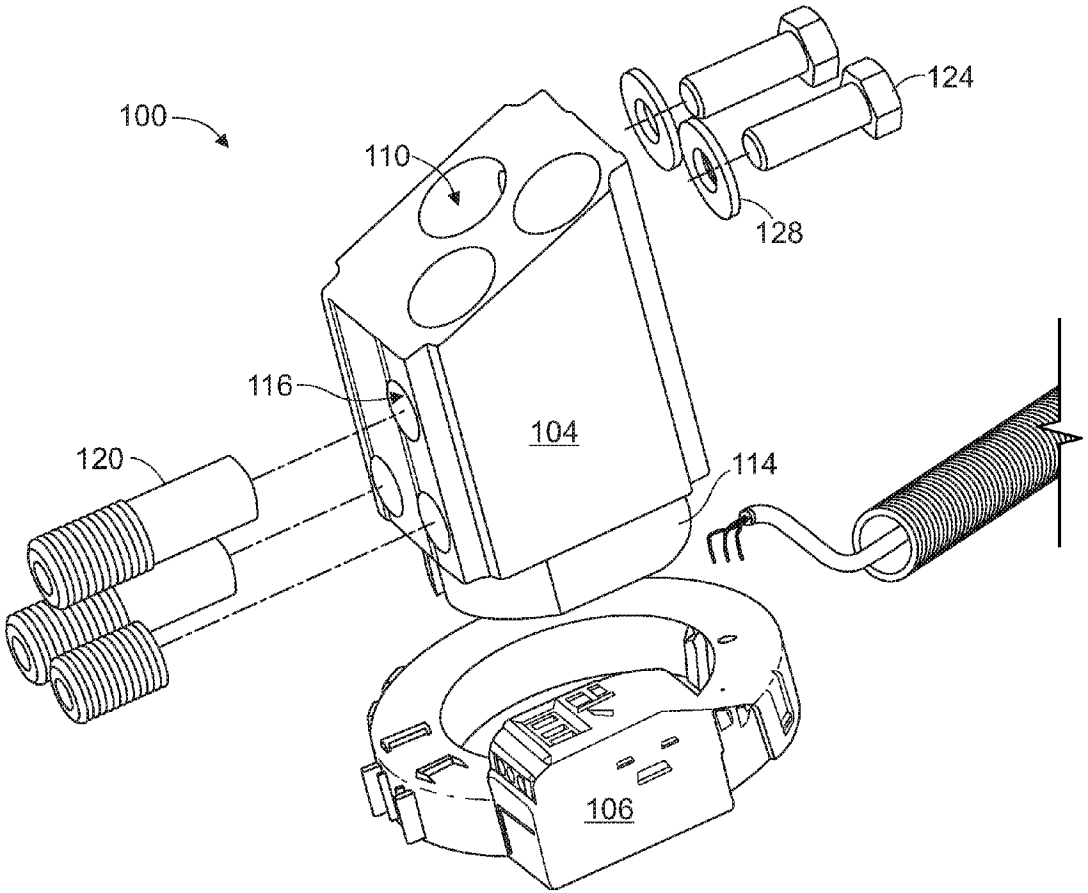
FIG. 3 is a perspective exploded view of a three-wire transformer assembly.

Referring to FIG. 3, as mentioned above, the number of conductor bores 110 can vary based on the particular requirements. The exemplary embodiment illustrated in FIG. 3 has three conductor bores 110.

Figure 4:
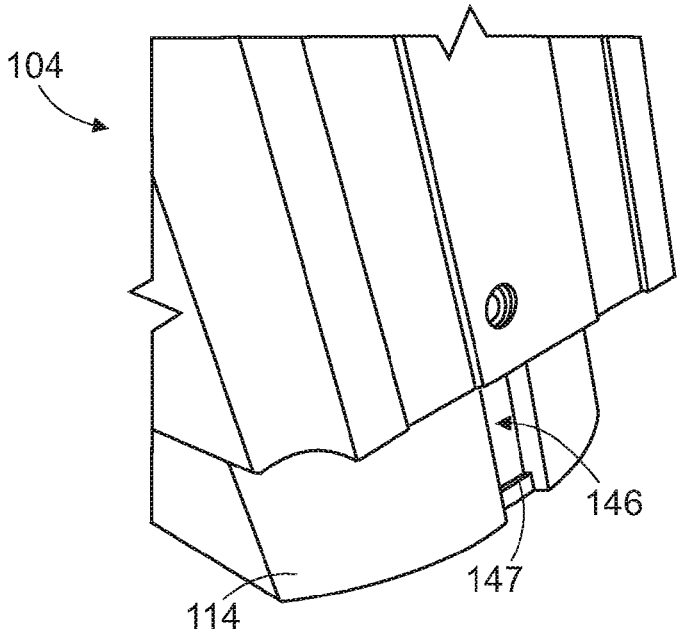
FIG. 4 is a perspective view of a connecting slot of a mechanical lug.

Referring to FIG. 4, the mounting end 114 of the mechanical lug 104 has at least one connecting slot 146 (also shown in FIG. 2B) for connecting the mechanical lug 104 to the current transformer 106. The connecting slot 146 is a generally rectangular slot that has a stop surface 147 at the entry point of the slot. As explained in more detail below in reference to FIGS. 6A-6C, the stop surface 147 helps secure the mechanical lug 104 to the current transformer 106.

Figure 5:
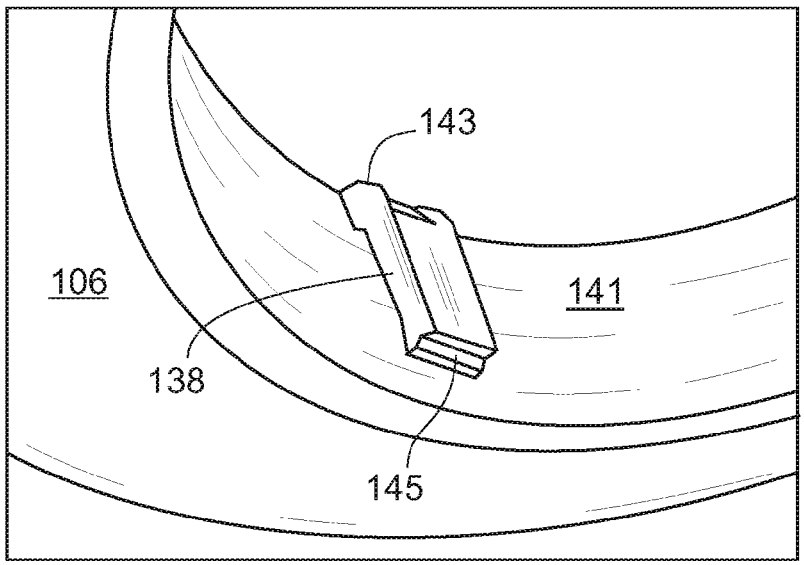
FIG. 5 is a perspective view of a connecting tab of a current transformer

Referring to FIG. 5, the connecting tab 138 of the current transformer 106 is connected to an interior wall 141 via a bridge member 143. The connecting tab 138 is generally a spring member that has a flexible tab end 145, which is movable away from or towards the interior wall 141 in a resilient manner.

Figure 6A:
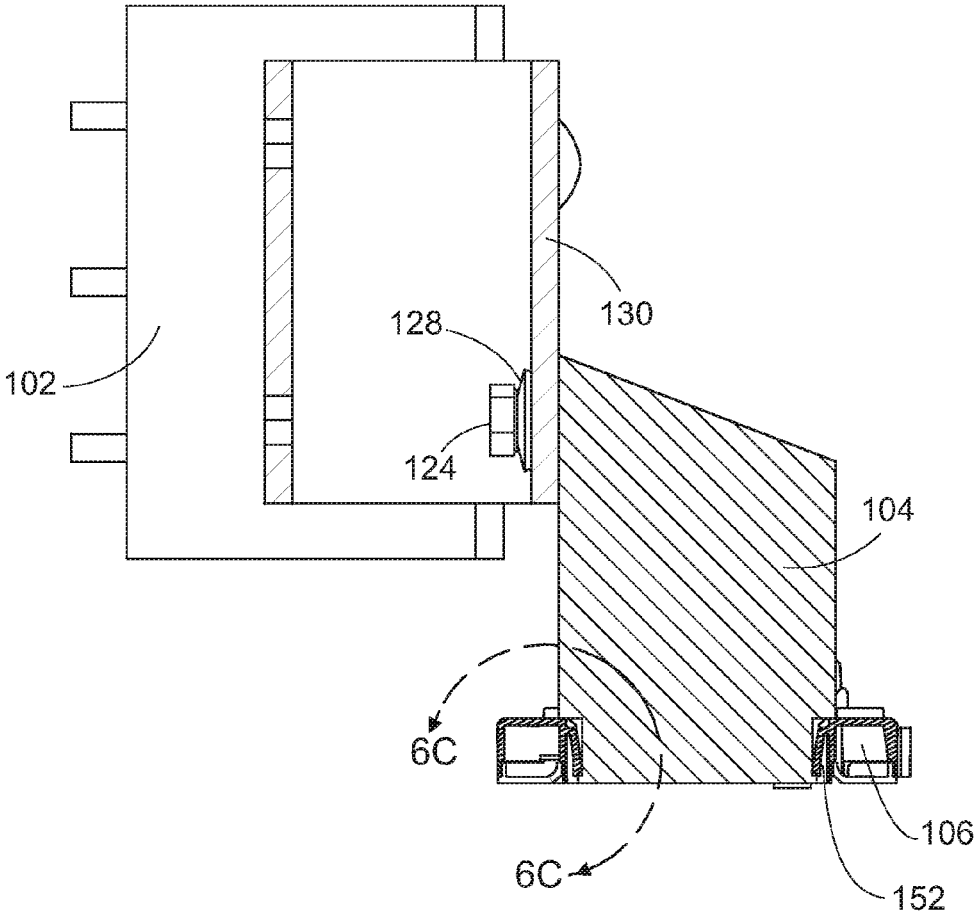
FIG. 6A is a cross-sectional view of the transformer assembly and busway system of FIG. 1.
Figure 6B:
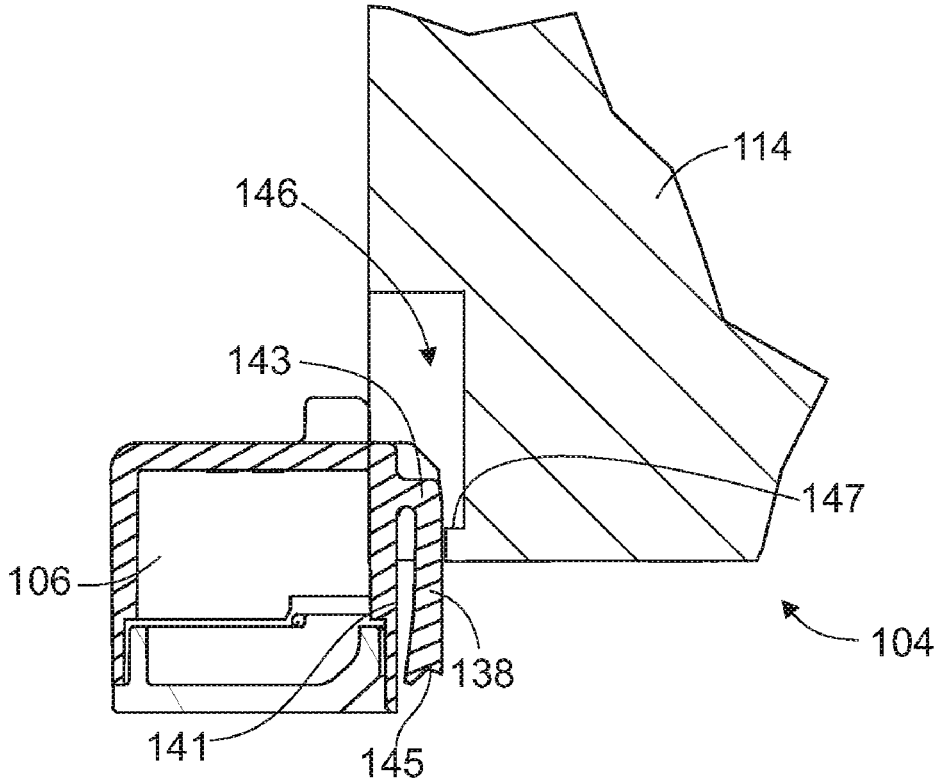
FIG. 6B is an enlarged view of FIG. 6A showing a connecting tab partially inserted within a connecting slot.
Figure 6C:
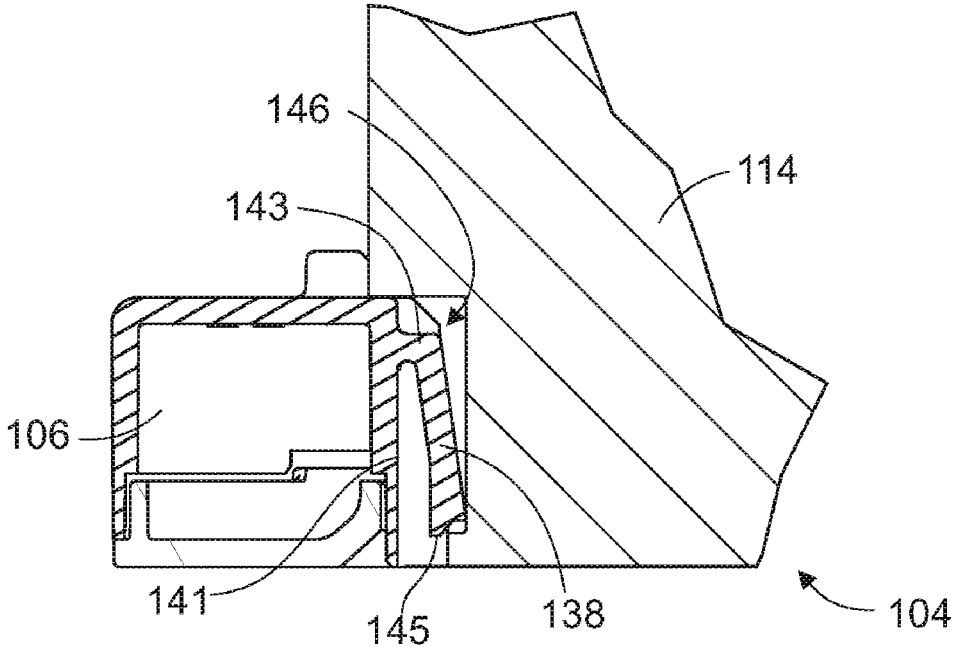
FIG. 6C is an enlarged view of FIG. 6A showing the connecting tab of FIG. 6B completely inserted within the connecting slot.

Referring to FIGS. 6A-6C, the mounting end 114 of the mechanical lug 104 interfaces with the transformer housing 134 using a connection between the connecting slot 146 and the connecting tab 138. As specifically shown in FIG. 6B, the connecting tab 138 is inserted in the connecting slot 146. During the insertion, the stop surface 147 forces the connecting tab 138 to move slightly towards the interior wall 141. When the connecting tab 138 is completely inserted within the connecting slot 146 (shown in FIG. 6C), the spring force of the connecting tab 138 forces the tab end 145 against the stop surface 147, which prevents separation of the mechanical lug 104 and the transformer housing 134.

A second pair of a connecting tab and a connecting slot (not shown), collectively identified in FIG. 6A at 152, is located generally diametrically opposite the first pair of connecting tab 138 and connecting slot 146. Alternatively, any number of connecting tabs and connecting slots can be used. According to alternative embodiments, the current transformer 106 can be secured to the mechanical lug 104 using any fastening methods, e.g., bolts, screws, rivets, adhesives, press-fitting, etc.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A transformer assembly for an electrical apparatus, comprising:

a current transformer for sensing electrical current in an electrical apparatus, the current transformer having a housing with an internal opening; and a mechanical lug mounted directly to the housing of the current transformer within the internal opening, the mechanical lug having a plurality of conductor bores located within a main body of the mechanical lug for receiving respective conductor wires, each of the conductor bores being located in part within the internal opening of the current transformer such that the conductor wires are receivable, respectively, in the conductor bores and within the internal opening, the mechanical lug having a mechanical lug apparatus for being attached to the electrical apparatus.

2. The transformer assembly of claim 1, wherein the mechanical lug is made from an electrically conductive material.

3. The transformer assembly of claim 2, wherein the electrically conductive material is selected from a group consisting of aluminum and copper.

4. The transformer assembly of claim 1, further comprising a plurality of fastener openings, each of the fastener openings corresponding to a respective one of the conductor bores.

5. The transformer assembly of claim 4, wherein the fastener openings are parallel to each other.

6. The transformer assembly of claim 4, wherein the fastener openings are perpendicular to the conductor bores.

7. The transformer assembly of claim 4, further comprising a plurality of conductor fasteners, each of the conductor fasteners being connected in a corresponding one of the fastener openings for securing a respective one of a plurality of conductor wires to the mechanical lug.

8. The transformer assembly of claim 1, wherein the mechanical lug apparatus for being attached to the electrical apparatus further comprises one or more mounting fasteners for mounting the mechanical lug to the electrical apparatus, the one or more mounting fasteners being located on a surface of the lug opposite to a surface of the lug on which a plurality of conductor fasteners are mounted, the conductor fasteners being connectable into corresponding fastener openings for securing respective conductor wires to the mechanical lug.

9. The transformer assembly of claim 1, wherein the current transformer includes a plurality of connecting tabs and the mechanical lug includes a plurality of corresponding connecting slots, each of the connecting tabs being secured within corresponding ones of the connecting slots.

10. An electrical system comprising:

an electrical apparatus;

a mechanical lug physically and electrically mounted directly to the electrical apparatus, the mechanical lug including one or more conductor bores for receiving, respectively, one or more conductor wires, the conductor wires being attached to the mechanical lug via respective conductor fasteners; and a current transformer for sensing electrical current in the electrical apparatus, the current transformer being physically connected directly to the mechanical lug by having an internal opening in which the mechanical lug is received, each of the conductor bores being located in part within the internal opening of the current transformer such that the conductor wires are receivable, respectively, in the conductor bores and within the internal opening.

11. The electrical system of claim 10, wherein the mechanical lug is made from an electrically conductive material.

12. The electrical system of claim 10, wherein the current transformer is connected to the mechanical lug near one end of the mechanical lug, the current transformer having a housing with connecting tabs extending internally in the internal opening, the connecting tabs of the transformer being received within corresponding connecting slots of the mechanical lug.

13. The electrical system of claim 12, wherein the current transformer is connected to the mechanical lug near one end of the mechanical lug, the connecting slots having stop surfaces for retaining corresponding ones of the connecting tabs.

14. The electrical system of claim 10, wherein the conductor bores are parallel to each other and extend from one end of the mechanical lug to an opposite end of the mechanical lug.

15. The electrical system of claim 10, wherein the conductor bores are perpendicular to the conductor fasteners, the conductor fasteners being inserted in respective ones of a plurality of fastener openings.

* * * * *